United States Patent [19]

Bauer et al.

[11] Patent Number: 4,466,105

[45] Date of Patent: Aug. 14, 1984

[54] ELECTRODE FOR ARC FURNACES

[75] Inventors: Hanns Georg Bauer, Witten-Bommern, Fed. Rep. of Germany; Dieter H. Zöllner, Claremorris, Ireland; Josef Otto; Josef Mühlenbeck, both of Wetter, Fed. Rep. of Germany; Friedrich Rittmann, Rückersdorf, Fed. Rep. of Germany; Claudio Conradty, Röthenbach, Fed. Rep. of Germany; Inge Lauterbach-Dammler, Nuremberg, Fed. Rep. of Germany; Horst Sonke, Leinburg, Fed. Rep. of Germany

[73] Assignee: Arc Technologies Systems Ltd.

[21] Appl. No.: 285,515

[22] Filed: Jul. 21, 1981

[51] Int. Cl.[3] ..... H05B 7/08

[52] U.S. Cl. ..... 373/93

[58] Field of Search ..... 373/93, 92, 91

[56] References Cited

U.S. PATENT DOCUMENTS 4,145,564 3/1979 Andrew et al. ..... 373/93

4,291,190 9/1981 Elsner et al. ..... 373/93

*Primary Examiner*—R. Envall

*Attorney, Agent, or Firm*—Woodrow W. Ban; Arthur S. Collins

[57] ABSTRACT

An electrode for arc furnaces comprising a top portion of metal and a replaceable bottom portion of a material which, when appropriate, is only slowly consumed having a substantially cylindrical shape and being joined each to the other by a screwmounting, for example by means of a screw nipple or the like. The top portion includes a liquid cooling device or means with a header and a return duct, and an insulating coating of high temperature stability. An inner part and an outer part of the top portion are constructed so as to be detachable each from the other. The inner part extends substantially adjacent the screw nipple and at least a portion of the inner part is provided with an insulating coating of high temperature stability, which represents a loosely surmounted moulding.

35 Claims, 5 Drawing Figures

ELECTRODE FOR ARC FURNACES

FIELD OF THE INVENTION

The invention relates to arc furnace electrodes, having a top portion of metal and a replaceable bottom portion of consumable or slowly consumable material each of substantially cylindrical shape, and joined to each other by a screwmounting, for example a screw nipple or the like, and the top portion being provided with a liquid cooling device or means having a header and a return; at least a part of the top portion being protected by an insulating coating of high temperature stability.

BACKGROUND OF THE INVENTION

Electrodes of this general nature have already been described in Belgian Patent Specification No. 867 876. The metal shank of electrodes described therein contains the cooling system or means and is covered by an externally disposed compound having a high temperature stability. Apparently such coating is continuous and hooks in the metal shank are provided to improve adhesion.

Similar electrodes are also claimed within the framework of British Patent Specification No. 1 223 162 in which the entire metal shank is covered with a protective ceramic coating. According to this proposal, efforts are made to ensure that the ceramic coating is as thin as possible and penetrates into the metal shank itself to provide a substantial degree of insulation for the tubes extending therein. These tubes simultaneously function for cooling ducting purposes and provide an electrical connection to the consumable electrode portion of graphite.

European Patent Application No. 79302809.3 describes an electrode in which the mechanical contact of the metal shank, laterally disposed externally, is supported so as to be insulated with respect to the internally disposed metallic cooling system. The bottom part of the metallic cooling shank is again provided with a ceramic coating, secured by hooks and extending approximately to the height of a screw nipple connection.

German Auslegeschrift No. 27 39 483 also describes an electrode of the above-mentioned kind in which liquid cooling is ensured employing annular ducts directly guided upon an outer wall. The liquid return preferably directly adjoins external surfaces of the metal shank so that the external wall of the metal shank also represents the internal wall of the return duct. The electrode includes two components or parts, the entire internal or inner part being removable from the external part of the top portion. To this end it is necessary to release the screw bolts of a ring flange and to lift out the internal structure after shutting down the supply of liquid and emptying the cooling system. In the event of damage to the region of the top portion this electrode does not however permit the adoption of rapid and relative simple means for repair. Moreover, mechanical damage of the top portion or a short circuit may lead to introduction of water into the arc furnace and consequent explosions due to the externally disposed annular duct and return duct.

Electrodes for arc furnaces are exposed to severe stresses. This is explained by elevated operating temperatures to which the electrode is exposed, for example in the production of electrode steel, for which such electrodes are most frequently employed. Losses due to side oxidation are also caused by the electric arc which extends into the melt away from the bottom electrode tip only in an ideal case. Finally, there is the risk of arc travelling or lateral striking of the arc which can also take place above the consumable part in the event of defects and thereby cause short circuits. Furthermore, the electrodes are subject to different temperatures in the feed and return of the coolant and in the region of the consumable part by comparison with the power supply unit and cooling unit. Consequently the region of the screw nipple represents a particularly endangered place.

Additional and substantial mechanical stresses result from the insertion of the electrodes, boiling distortion and also are due to scrap pieces which slide into the melt.

Due to the stringent operating requirements made on electrodes they require constant improvement. It is therefore the object of the invention to provide electrodes of high activity with a low current drop and low voltage in the supply lead, with the least tendency to be trouble prone but being also easy to manufacture and to repair. Particularly in cases of undesirable shift of the arc or excessive mechanical stresses such electrodes must allow the electrode arc process to be continued, even in the event of partial damage, in a manner which is improved compared with that of conventional arc electrodes.

DISCLOSURE OF THE INVENTION

This problem is solved by an electrode generally of the kind described hereinbefore. Specifically this invention provides an electrode for arc furnaces comprising a top portion of metal and a replaceable bottom portion of consumable material, the portions being substantially cylindrical and being connected to each other by a screwmounting, wherein the top portion is provided with a liquid cooling device having a header duct and a return duct and including an inner and outer parts detachable one from the other, wherein said inner part extends substantially adjacent the screwmounting and wherein at least a partial zone of the inner part is protected by a detachable moulding of high temperature stability.

According to a preferred embodiment of the electrode according to the invention, the inner part and the outer part of the top portion are constructed to be detachable from each other, the inner part containing a liquid chamber including the header duct and return duct.

The outer part represents the terminal electrode and can consist of the same metal, for example copper or a metal alloy or other materials, as the inner part. Cooling ports or the like can be provided in the outer part. It is also possible to provide the outer part with retaining bores, for example for guiding and supporting insulating protector strata which are disposed below.

In one preferred embodiment of the electrode according to the invention only a part region of the inner part is surrounded by the outer part, so that a metal electrode shank can be formed in its entirety from a top region of larger diameter and a bottom region of a smaller diameter.

The inner part of the electrode extends as far as a screw nipple connection by means of which the top portion of metal and the consumable bottom portion are interconnected. The liquid cooling device of the inner part, extending axially therein, is advantageously introduced into the screw nipple itself, because this may be exposed to a special heat stress, depending on the materials employed.

The inner and outer parts can be connected in different ways. The line of connection usually extends parallel with the electrode axis. For example, the detachable connection can be obtained by screwthreading or by appropriate fitting of the parts. It is particularly advantageous if the inner part is formed as a register member in taper or conical form and a part region of the outer and inner part can, where appropriate, have additional screwthreading.

Connecting jaws, to which the current supply for the electrode is connected, can be attached to the outer part by pockets or retaining means. Pockets, in which graphite plates or segments are introduced to supply current, are attached to the outer part in one preferred embodiment of the invention.

An insulating coating of high temperature stability, representing a moulding in accordance with the invention, can be provided in the form of an individual tube or advantageously, the moulding can also be a series of tubular sections, segments, half shells or the like which surround the bottom region or inner part of the top portion of the electrode as far as the region of the screw nipple or, where appropriate, beyond. The material of the insulating moulding can be ceramic of high temperature stability but can also be graphite covered by an insulating coating. Such insulating ceramic materials of high temperature stability or other graphite materials are known.

A series of advantages are achieved by the use of a detachably surmountable moulding, more particularly in the form of a series of tubular sections.

According to a preferred embodiment of the electrode according to the invention, the insulating moulding is disposed between the top metal electrode portion and the bottom consumable portion so that the external edges or surfaces of the moulding extending in the direction of the electrode axis and the external edges of an outer region associated with the top metal electrode portion, are substantially flush with each other.

The electrode according to the invention is not subject to restrictions regarding an abutment for supporting the moulding. Such an abutment can also be a mating member of an insulating material having a high temperature stability; it can be the screw nipple itself, and where appropriate can also be part of the consumable portion or a part of a combination of the screw nipple and consumable portion. Generally, however, the insulating moulding will not bear solely on the consumable part but will be supported at least partially by a non-consumable, heat resistant, insulating material.

The position of the moulding can naturally be controlled in suitable manner when the electrode is produced. In one preferred embodiment of the electrode according to the invention, the insulating moulding can be thrust upon the abutment by means of pins, screw fasteners and the like in bores situated in the top portion, for example by the additional provision of springs, while the electrode is in operation and without the need for removing the electrode from the furnace.

Apart from the provision of bores, screw fasteners or the like it can also be advantageous to mount the insulating moulding slidingly or loosely with respect to the metal shank so that in the event of failure of a part segment or breakage of the individual tube, for example due to mechanical damage, the remaining and intact part segments or the individual tube itself is able to follow up or is removable in the direction of the longitudinal axis of the electrode.

In one preferred embodiment the electrode according to the invention is arranged so that an electrically conductive intermediate layer of high temperature stability is introduced between the insulating moulding of high temperature stability and the internally disposed part of the metal shank. By analogy with the externally disposed insulating moulding, the electrically conductive intermediate layer can also be an individual tube but also can be represented by a series of tubular portions, segments, half shells or the like. An electrically conductive fabric of high temperature stability can however also be used as such an intermediate layer in place of preformed mouldings. The electrically conductive intermediate layer can comprise a combination of a series of tubular sections with a felt or fabric of high temperature stability for some purposes of the electrode according to the invention. The use of conductive felt or fibre non-woven fabric or fabric of high temperature stability is preferred, especially for purposes in which the electrode is exposed to mechanical shock or vibration during operation. Due to the introduction of the felts etc. it is possible for the externally disposed insulating parts to be resiliently supported, a feature which contributes to additional stabilization of the electrode.

Where extreme reliability of the electrode is essential it is also possible to additionally provide a highly stressable, conductive thin coating on the internally disposed metal shank which is protected by the electrically insulating and by the electrically conductive coating. Such coating can be a ceramic coating.

The electrically conductive intermediate layer can comprise conductive ceramic, graphite, ceramic, mineral or carbon fibers, fabrics or felts or any combination thereof.

Depending on the purpose of the electrode it is possible to mount the insulating moulding as well as the conductive intermediate layer on the retaining means which can be advantageously attached to the metal of the inner cooling unit or part. This will be considered primarily for uses of the electrodes in which free movability or "follow up" of intact (insulating or electrically conductive) individual segments is not necessary if one of the segments disposed below is damaged.

Within the scope of the invention it is also possible for the insulating moulding not to surround the entire extent of the metal shank between the outer part and the consumable portion which is to be protected, and an insulating, high refractory injection compound, anchored by means of retaining members, is used in place of the extended moulding in a zone where lesser stresses can be expected. Such insulating injection compounds it is known can be mounted by means of retaining members, for example by soldering.

The connection between the top and bottom portion can be obtained particularly conveniently by means of a nipple which is cylindrical on the metal side and conical on the consuming side. This construction aspect has proved particularly advantageous during tests. Metal, and especially cast iron, is considered as a material of construction for the nipple, since the resistance value of particularly cast iron is similar to those of graphites from which the consumable part is normally constructed. Nipple connections made of graphite are, however, also considered owing to the high degree of stability of graphite to alternating temperatures. According to a special embodiment of the invention, the bottom portion can comprise a plurality of consumable units which are retained by one or more nipple connections and the consumable units can be arranged adjacently or one below the other. The use of an "insert member" of graphite between the top portion and the bottom portion, where the lower consumable portion can be connected to the insert member by means of a nipple connection, for example of graphite, offers an advantage in the sense that the nipple connection between the metal shank and the graphite insert member remains cooler and the consumable member can be completely consumed without causing any risk of damage to the top portion. Alternatively, a safety zone would have to be left on a consumable end piece to protect the nipple and the bottom region of the top portion (the inner part), so that this safety zone would be lost. It is also possible and in some cases convenient, to construct the consumable part of the electrode from a plurality of tubes, rods and/or plates each of which have a preferential direction which coincides with the current supply direction. Such arrangements are described in detail in the European Patent Application No. 80103126.1 filed by the Applicant on the June 4, 1980 and the principle disclosed thereby is to be fully included herein.

Finally, it can be advantageous, in view of the temperature stresses imposed on the nipple, for such nipples to be laterally slotted to equalize thermal stresses. A number of advantages are achieved using electrodes made according to the invention. Firstly, the insulating moulding as well as the electrically conductive coating can be arranged in a purpose-made position relative each to the other during manufacture. The mechanical stressability can be improved by the use of an insulating solid component which is disposed on the outside. This is particularly important for electrodes used for the production of electrosteel. The immersion of scrap into the melt can lead to substantial excitation of the melt accompanied by corresponding mechanical loadings upon the electrode. By subdividing the insulating as well as the conductive zones into segments it is not necessary to exchange the entire electrode in the event of defects or damage, since the damage can be economically and reliably remedied by fitting the appropriate part member.

In the event of mechanical or other destruction of protective segments disposed below, the loose mounting of the insulating moulding, as well as of the conductive coating if any, to the extent to which this is formed from mouldings, leads to "automatic" follow-up of the moulding segments disposed above and this action can be additionally ensured where appropriate by attached springs. If damage has already taken place, the electrode therefore continues to be operational because the most endangered electrode region at the bottom, nearest to the working zone of the electrode, is "automatically" protected by downward sliding of intact elements. Mechanical shocks resulting from sliding scrap, boiling distortion etc, are absorbed by the resilient support of the insulating layer in axial parts of the electrodes as well as by the internal cushioning of the electrically conductive coating of fibres, carbon felt and fabrics etc. if any in a particularly advantageous manner.

Although the insulating moulding or the insulating coating, if this comprises a series of individual segments, has come clearance defined by the kind of axial support as well as by the internal support or inner part, complete and comprehensive protection of the sensitive metal region of the electrode is obtained, for example, by virtue of a tongue and groove-system associated with any segments. If the "protective shield" of the electrode is nevertheless damaged, the electrode can usually continue to operate until the consumable part is replaced as a routine operation. When the electrode is removed, the damaged individual segments etc. can be readily replaced without any additional effort.

The internally disposed electrically conductive coating of material having high temperature stability, for example conductive ceramic or graphite or carbon felts etc. can confer emergency operating properties on the electrode. If the outer ring or insulative coating breaks, the internally disposed electrically conductive coating will be able to withstand the temperatures of an arc which might be formed. The relatively sensitive internally disposed metal shank or inner part is therefrom protected against the heat of an arc, which may be stuck on the side, so that the electrode should not immediately fail. The latter effect is possible in conventional electrodes if the externally disposed, insulating coating is destroyed either mechanically or in some other manner and the arc is struck directly on the metal shank which is then unable to withstand the extreme temperatures of the arc.

The inventive subdivision of the metal shank also provides advantageous electrode properties. Owing to the water conductive system being contained within the interior part, it remains intact even if the outer part is mechanically damaged. When the outer region or part of the top portion is damaged it is therefore not necessary to shut down the supply of coolant, to discharge the electrode etc. By virtue of the simple detachability of the outer portion or part, the outer part can readily be exchanged as a component in case of damage while conventional electrode construction necessitates a complete repair of the metal shank or the replacement thereof.

The supply of electrical current being lateral, for example by means of graphite contact jaws or segments, which are attached, for example in retaining pockets, it is not necessary in the event of defects in the region of the internally disposed liquid conducting system, to remove the electrode in its entirety from the busbar since only the internal part requires detachment. By constructing the top region as a section of larger diameter outer part and a section of smaller diameter inner part it is possible for the insulating protective system of high temperature stability to be attached in a particularly compact and convenient form and it may then not be necessary for the outer part to be additionally protected in an insulating manner if such part is confined to the region in which electrical current is supplied to the electrode.

Special preferred electrode constructions of the invention are illustrated in FIGS. 1 to 5. The drawings in particular show electrodes in which the top portion of conductive metal has a top or outer part of larger diameter and a bottom or inner part of smaller diameter. The part of smaller diameter is then covered by the insulating moulding and the conductive coating. This arrangement is particularly preferred within the scope of the invention although the invention is neither confined to the particularly advantageous embodiments according to the drawings described below. Identical parts are designated with identical reference numerals in the drawings in which:

DETAILED DESCRIPTION OF THE INVENTION

Figure 1:
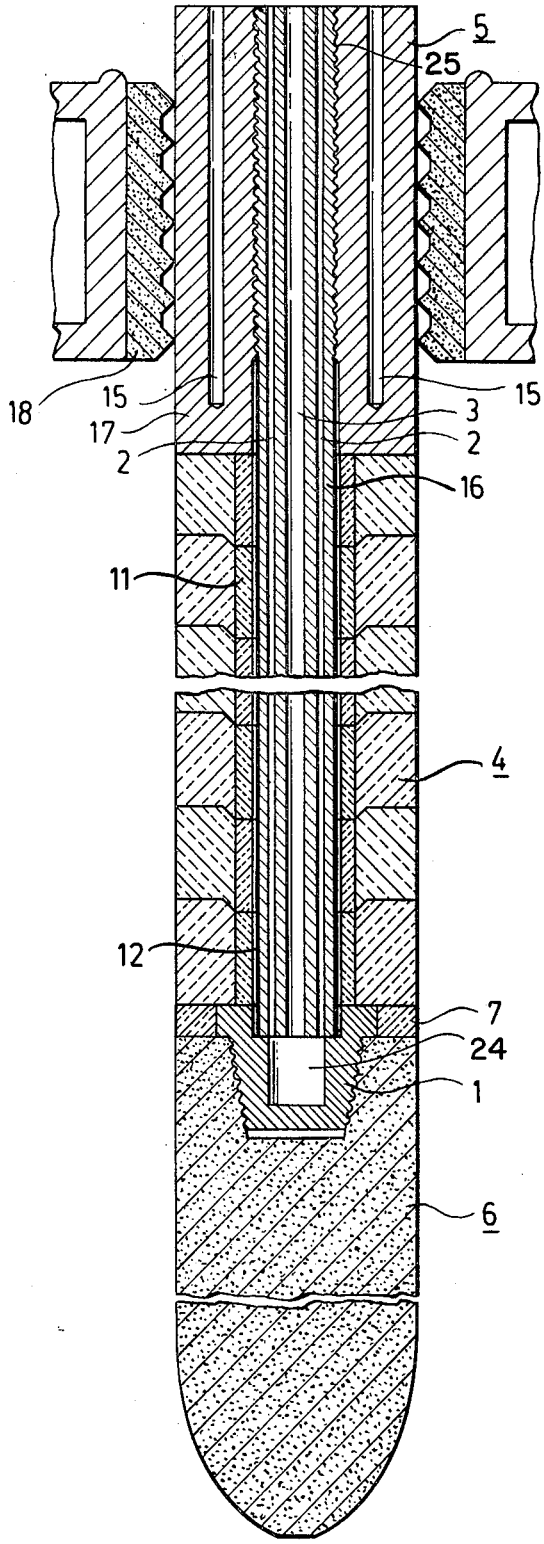
FIGS. 1, and 2, are longitudinal sections through an electrode according to the invention.

In the electrode, for example according to FIG. 1, the cooling medium, usually water, is introduced through the header duct 2 and returned through the return duct 3. The cooling system is disposed in an inner part 16 on which an outer part 17 is surmounted. The cooling medium also enters into a chamber 24 within a screw nipple 1, which is constructed, for example, of cast iron. The top portion 5 of metal, for example Cu, comprises the top region or part 17 of larger diameter and the lower region or part 16 of smaller diameter which is extended into the screw nipple 1 adapted to form the connection to the lower portion 6 of the consumable material, for example graphite. An insulating moulding 4 is supported by an abutment 7, for example of insulating ceramic having high temperature stability. In the top region or portion 5 the insulating moulding 4 is defined by the top edge of the metal shank region or part 17 of larger diameter. The insulating moulding 4 adjoins an electrically conductive intermediate layer 11 which is inwardly defined by the internal metal shank or part 16, and particularly its portion of smaller diameter 12. In the electrode illustrated in FIG. 1, the insulating moulding 4 as well as the electrically conductive intermediate layer 11 are subdivided into segments which can slide in the direction of an axis of the electrode in the event of a downwardly disposed such segment breaking out.

Figure 2:
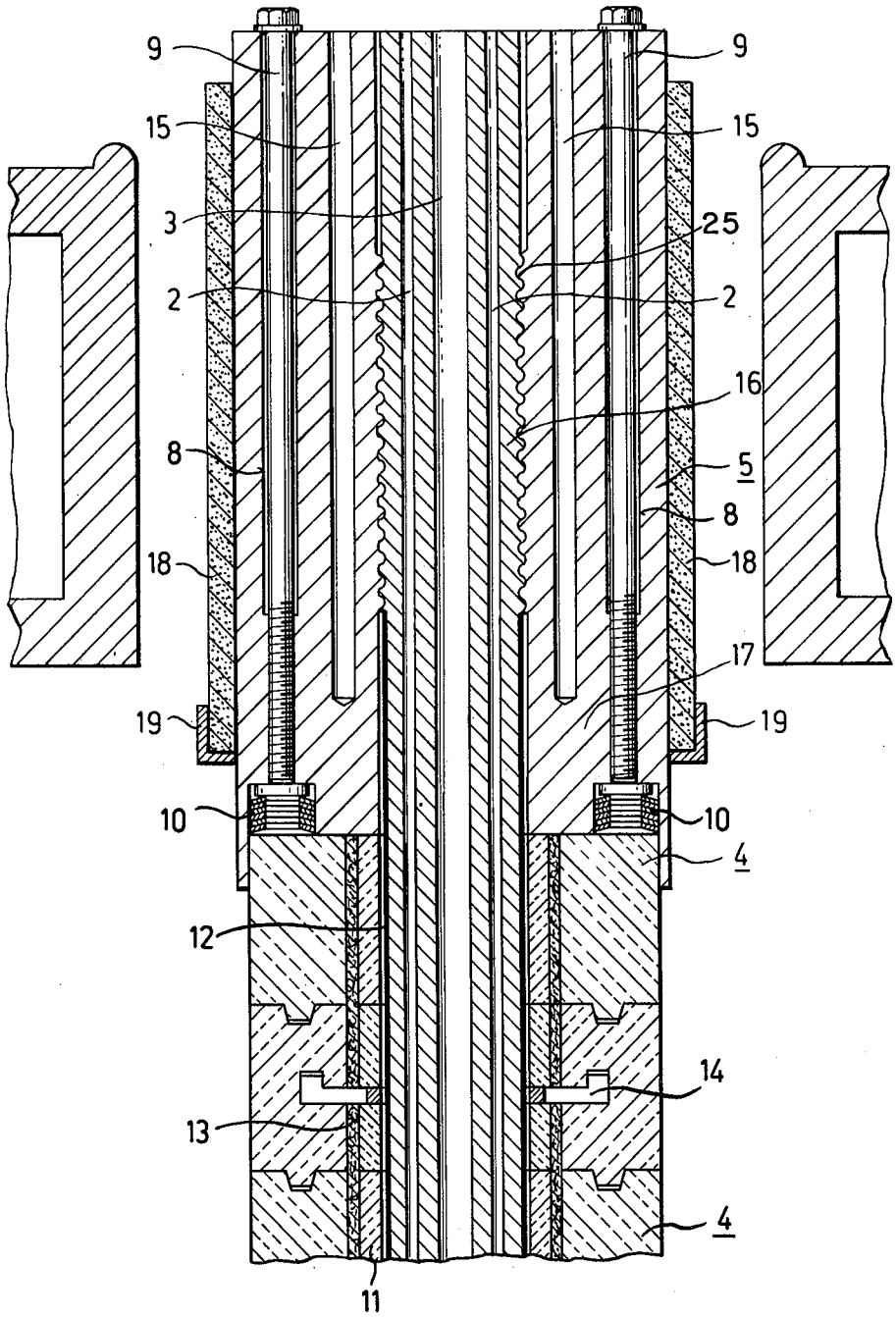
Figure 3:
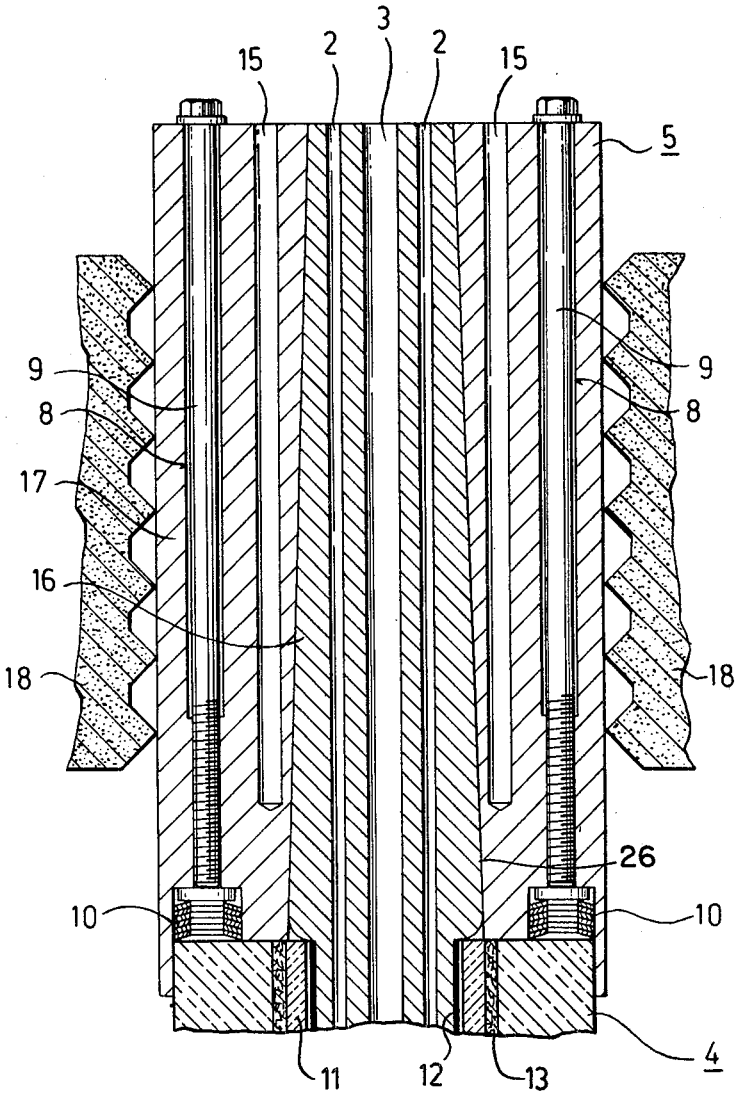
FIG. 3 is a longitudinal section through an electrode according to the invention in which the region protected by insulation is not completely shown and the adjoining consumable part is not shown.
Figure 4:
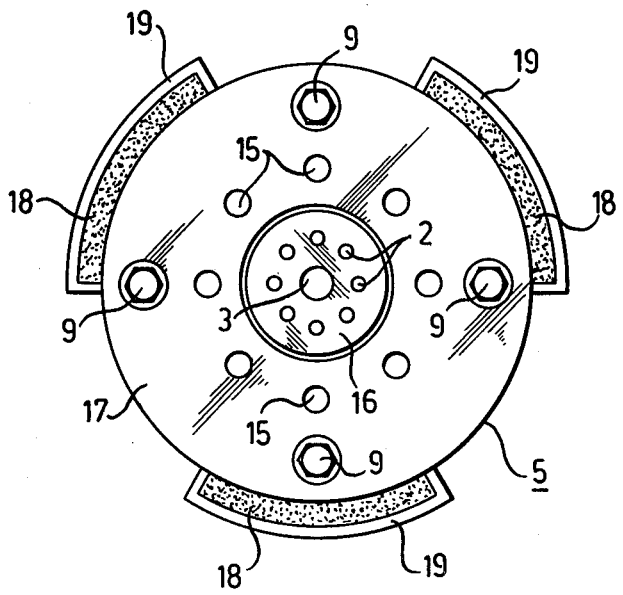
FIG. 4 is a cross-section through the top portion of metal or its part region of larger diameter.

FIGS. 1 to 3 disclose some of the preferred means of connecting the inner part 16 and the outer part 17 as a register member, where appropriate with the addition of partial screwthreading 25. Pins 9 or the like can be guided by means of bores 8 to retain the insulating coating 4 on the abutment 7 by means of a biasing spring 10. The insulating member can be additionally secured by retaining means 14. The outer part 17 is provided with cooling ports 15 while connecting jaws 18, for example of graphite, are shown on the outside. These can be secured by retaining means or pockets 19, secured to the outer edge of the metal shank, as also shown in FIG. 4.

FIG. 2 shows the use of laminate half shells joined together or of rings, for example of graphite, which are covered with an insulating coating, laminated with conductive felt 13, for example of carbon fiber. An electrically conductive protective ring 11, also segmented, for example of ceramic surface $ZrO_2$, $ZnO_2$, SiO etc. or graphite is additionally inserted between the internally disposed metal part 12, which is brought forward, and the conductive felt 13. The use of conductive, vibration damping material such as felt etc. in combination with electrically conductive solid parts of ceramic or graphite is particularly preferred for the electrode according to the invention.

As shown in FIG. 3, joinder of the inner 16 and outer parts 17 can be effected by a tapered fitting 26 therebetween, optionally including threading between inner 16 and outer 17 parts.

Figure 5:
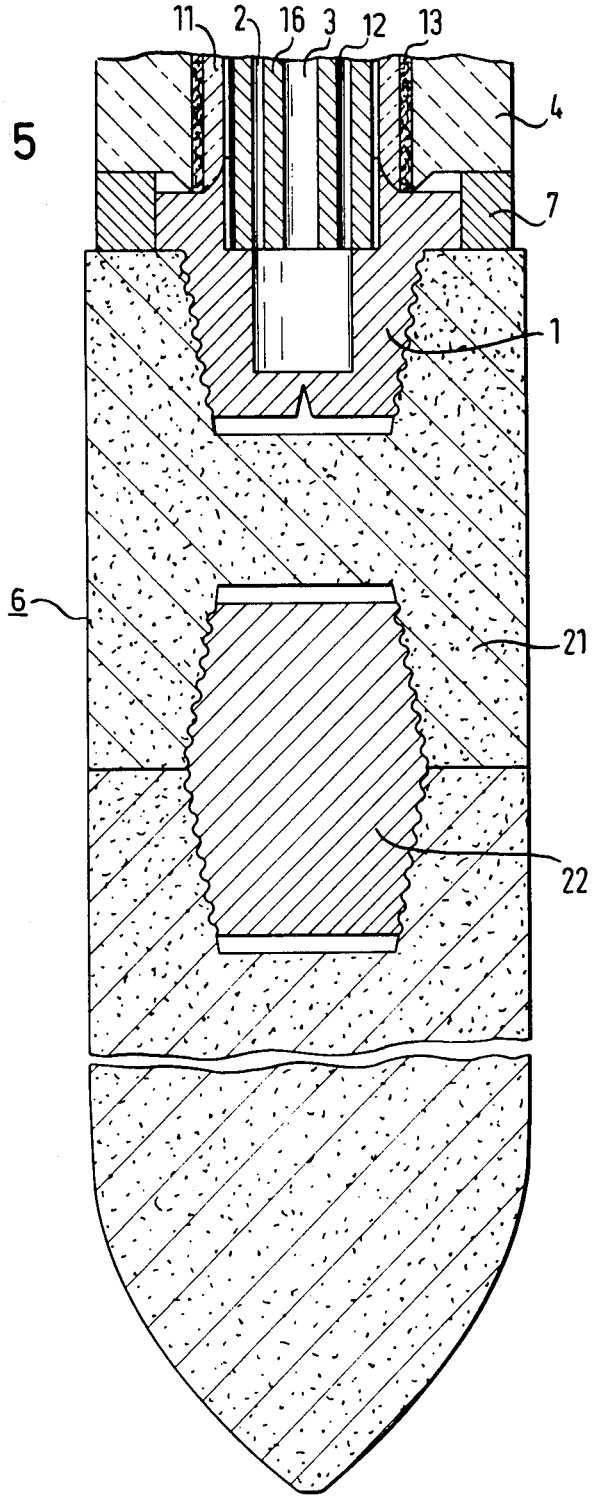
FIG. 5 is a longitudinal section through the lower electrode portion which the inserted intermediate member.

FIG. 5 finally shows an insert member 21 of graphite which is connected to the top portion 5 by means of a threaded nipple 1, advantageously constructed of, for example, copper, which is slotted to compensate for the thermal stresses. The insert member is connected to the actual consumable part by means of an additional threaded nipple connection 22, preferably formed from graphite.

We claim:

1. A metallurgical arc furnace having an electrode, said electrode comprising an upper, electrically conductive metallic portion and a consumable, replaceable lower portion, the portions being substantially cylindrical; a threadable interconnection between the portions, a liquid cooling means within the upper portion including a relatively large diameter outer component and a relatively smaller diameter inner component detachably received with the outer component, the inner component extending axially downwardly from the outer component to a point adjacent the threadable interconnection; and at least one insulating moulding having a substantially elevated temperature stability applied slidingly and detachably surroundinng at least a portion of the inner component the insulating moulding having an inner diameter sufficiently in excess of an outer diameter of the inner component at operating temperatures of the arc furnace whereby the insulating moulding slidingly surrounds the inner component.

2. The electrode of claim 1, the cooling means being received within the inner component.

3. The electrode of claim 1, the outer component being a terminal electrode.

4. The electrode of claim 1, the outer component including at least one cooling passage and at least one bore for receiving a retainer.

5. The electrode of claim 1, the inner component being threadably detachably received within the outer component within an axis of the electrode.

6. The electrode of claim 1, including a fitting along a longitudinal axis defined by the electrode providing a detachable connection between the inner component and outer component.

7. The electrode of claim 6, the fitting being of a threaded taper form for mating with threading provided upon the component.

8. The electrode of claim 1, including graphite connecting jaws gripping the outer component.

9. The electrode of claim 2, the liquid cooling means being contained within the inner component extending to a point adjacent the threadable interconnection.

10. The electrode of claim 1 the detachable moulding being tubular in form and surrounding the inner component of the upper portion substantially from a point adjacent the outer component to a point closely adjacent the threadable interconnection.

11. The electrode of claim 10, the tubular moulding being sectioned.

12. The electrode of claim the external surfaces of the moulding and an external surface of the outer component being substantially flush, each to the next.

13. The electrode of claim 1, the moulding surrounding the inner component being supported at least partially by the threadable interconnection.

14. The electrode of claim 1, a cut being provided in the metal of the upper portion and an abutment being provided in the region of the threadable interconnection both configured for supporting the moulding between the cut and the abutment.

15. The electrode of claim 14, the moulding being retained on the abutment by means of spring biased, bore guided, pins contained within the outer component.

16. The electrode of claim 1, including an electrically conductive intermediate layer having an elevated temperature stability positioned between the moulding and the inner component.

17. The electrode of claim 16 the intermediate layer being tubularly configured and fabricated at least partly of felt having an elevated temperature stability.

18. The electrode of claim 16 the intermediate layer being tubularly configured and including a fabric having an elevated temperature stability.

19. The electrode of either claim 17 or claim 19 the tubular intermediate layer being sectioned.

20. The electrode of claim 16 the inner component being coated with a highly stressable conductive ceramic coating.

21. The electrode of claim 1 the moulding comprising a ceramic having an elevated temperature stability.

22. The electrode of claim 1 the moulding comprising graphite tubing having an insulating coating.

23. The electrode of any one of claims 16 to 18, the intermediate layer comprising a ceramic.

24. The electrode of any one of claims 16 to 18, the intermediate layer comprising a graphite.

25. The electrode of any one of claims 16 to 18, the intermediate layer comprising a ceramic fabric.

26. The electrode of any one of claims 16 to 18, the intermediate layer comprising a mineral fabric.

27. The electrode of any one of claims 16 to 18, the intermediate layer comprising a felt.

28. The electrode of claim 16, at least one of the moulding and said the intermediate layer being mounted on a retaining means, the retaining means being attached to the cooling means.

29. The electrode of claim 1, a portion of the moulding being comprised adjacent the outer component of an insulating, injectable refractive compound anchored to the retaining members.

30. The electrode of claim 16, at least one of the moulding and the intermediate layer being slidably supported whereby in the event of a failure of a portion of the moulding, any remaining intact portions of moulding are movable in the direction of the electrode axis towards the stressing zone.

31. The electrode of claim 1, wherein said threadable interconnection includes a threaded nipple which is cylindrical where engaging the upper portion and conical where engaging the consumable portion.

32. The electrode of claim 31, the threaded nipple consisting essentially of cast iron.

33. The electrode of claim 31, the threaded nipple consisting essentially of graphite.

34. The electrode of claim 1, the consumable portion comprising a plurality of segments each retained longitudinally one to the next by a threaded nipple interconnection.

35. The electrode of any one of claims 31 to 34, such threaded nipples being slotted.

* * * * *

UNITED STATES PATENT AND TRADEMARK OFFICE

CERTIFICATE OF CORRECTION

PATENT NO. : 4,466,105

DATED : August 14, 1984

INVENTOR(S) : Bauer et al

It is certified that error appears in the above-identified patent and that said Letters Patent are hereby corrected as shown below:

In the Cover Page:

Left hand column, after [22] Filed: Jul. 21, 1981 there should be inserted
--Foreign Application Priority Data
Oct. 27, 1980 [EP] European Pat. Off. 80106583.0--

Signed and Sealed this

*Twenty-third* Day of *October 1984*

[SEAL]

*Attest:*

GERALD J. MOSSINGHOFF

*Attesting Officer*

*Commissioner of Patents and Trademarks*